US009224345B2

(12) United States Patent
Yang

(10) Patent No.: US 9,224,345 B2
(45) Date of Patent: Dec. 29, 2015

(54) LIQUID CRYSTAL DISPLAY AND DRIVING METHOD THEREOF

(75) Inventor: Junhyeok Yang, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 600 days.

(21) Appl. No.: 13/570,334

(22) Filed: Aug. 9, 2012

(65) Prior Publication Data

US 2013/0038591 A1 Feb. 14, 2013

(30) Foreign Application Priority Data

Aug. 11, 2011 (KR) ..... 10-2011-0080030

(51) Int. Cl.
*G09G 5/00* (2006.01)
*G09G 3/36* (2006.01)
*G09G 3/34* (2006.01)

(52) U.S. Cl.
CPC ... *G09G 3/36* (2013.01); *G09G 3/34* (2013.01)

(58) Field of Classification Search
CPC ..... G09G 3/36
See application file for complete search history.

(56) References Cited

U.S. PATENT DOCUMENTS

2003/0011559 A1* 1/2003 Adachi et al. ..... 345/102
2007/0222739 A1* 9/2007 Yu et al. ..... 345/102
2007/0285029 A1 12/2007 Kim
2008/0100232 A1* 5/2008 Miguchi ..... G09G 3/3413 315/294
2009/0015179 A1* 1/2009 Hatano ..... G09G 3/3406 315/307
2012/0049761 A1* 3/2012 Yu ..... G09G 3/3406 315/294
2014/0168567 A1* 6/2014 Kikuchi ..... H05B 33/0815 349/61

OTHER PUBLICATIONS

Office Action issued in counterpart Chinese Patent Application No. 201210128554.0 dated Apr. 1, 2014.

* cited by examiner

*Primary Examiner* — Jason Olson
(74) *Attorney, Agent, or Firm* — Morgan, Lewis & Bockius LLP

(57) ABSTRACT

A liquid crystal display comprises: a liquid crystal panel; a panel driver for driving the liquid crystal panel; a backlight unit providing light to the liquid crystal panel, and comprising light emitting sources having light emitting diodes connected in series and driving transistors driving the light emitting sources; and a backlight unit driver comprising a transistor driver that controls the driving transistors, a DC power source that supplies DC power to the light emitting sources, and a power controller that drives the DC power source, and enables or disables an output of the DC power source with reference to signals supplied to the driving transistors.

8 Claims, 11 Drawing Sheets

LIQUID CRYSTAL DISPLAY AND DRIVING METHOD THEREOF

This application claims the benefit of Korean Patent Application No. 10-2011-0080030 filed on Aug. 11, 2011, which is hereby incorporated by reference.

BACKGROUND

1. Field

This document relates to a liquid crystal display and a driving method thereof.

2. Related Art

As the information technology is developed, the market for display devices used as connection mediums between users and information is growing. Accordingly, the use of flat panel displays (FPDs) such as a liquid crystal display (LCD), an organic light emitting diode (OLED) display, and a plasma display panel (PDP) is increasing. Of these, liquid crystal displays are widely used because they have a high resolution and can be big as well as small.

The liquid crystal display comprises a transistor substrate, on which thin film transistors, storage capacitors, pixel electrodes, etc. are formed, a color filter substrate on which color filters, black matrixes, etc. are formed, and a liquid crystal layer positioned between the transistor substrate and the color filter substrate. The liquid crystal display displays images by adjusting the amount of light passing through the liquid crystal layer by an electric filed applied to between a pixel electrode and a common electrode.

A backlight unit emits light by being controlled by a backlight unit driver comprising a DC power source for outputting DC power, a driving transistor for driving the backlight unit, and a transistor driver.

However, the prior art backlight unit driver does not forcibly disable the DC power source even if it is in an unloaded condition, i.e., load-off condition. Accordingly, if an abrupt load change occurs in the prior art backlight unit driver, a voltage ripple is generated at an output terminal of the DC power source, and this causes noise. Hence, a solution for this problem is required.

SUMMARY

Embodiments of the invention provide a liquid crystal display, which can minimize voltage ripple at an output terminal of the DC power source while in the load-off condition, and therefore solves the problem of noise.

In one aspect, an exemplary embodiment of the present invention provides a liquid crystal display comprising: a liquid crystal panel; a panel driver for driving the liquid crystal panel; a backlight unit providing light to the liquid crystal panel, and comprising light emitting sources having light emitting diodes connected in series and driving transistors driving the light emitting sources; and a backlight unit driver comprising a transistor driver that controls the driving transistors, a DC power source that supplies DC power to the light emitting sources, and a power controller that drives the DC power source, and enables or disables an output of the DC power source with reference to signals supplied to the driving transistors.

In an aspect, an exemplary embodiment of the present invention provides a liquid crystal display comprising: a liquid crystal panel; a panel driver for driving the liquid crystal panel; a backlight unit providing light to the liquid crystal panel, and comprising light emitting sources comprising light emitting diodes connected in series and driving transistors driving the light emitting sources; and a backlight unit driver comprising a transistor driver that controls the driving transistors, a DC power source that supplies DC power to the light emitting sources, and a pulse width modulator power that drives the DC power source, performs an logic operation on a signal generated internally and a signal supplied from the transistor driver to generate a result value, and enables or disables an output of the DC power source based on the result value.

In yet another aspect, an exemplary embodiment of the present invention provides a driving method of a liquid crystal display, the method comprising: driving a DC power source to boost a first DC power voltage supplied from an external source into a second DC power voltage and supply the same to a backlight unit; driving driving transistors of the backlight unit to emit light from the backlight unit; and displaying an image on the liquid crystal panel using the light emitted from the backlight unit, wherein, in the driving of the DC power source, an output of the DC power source is enabled or disabled with reference to signals supplied to the driving transistors.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION

Reference will now be made in detail to embodiments, examples of which are illustrated in the accompanying drawings.

Hereinafter, an implementation of this document will be described in detail with reference to the attached drawings.

Figure 1:
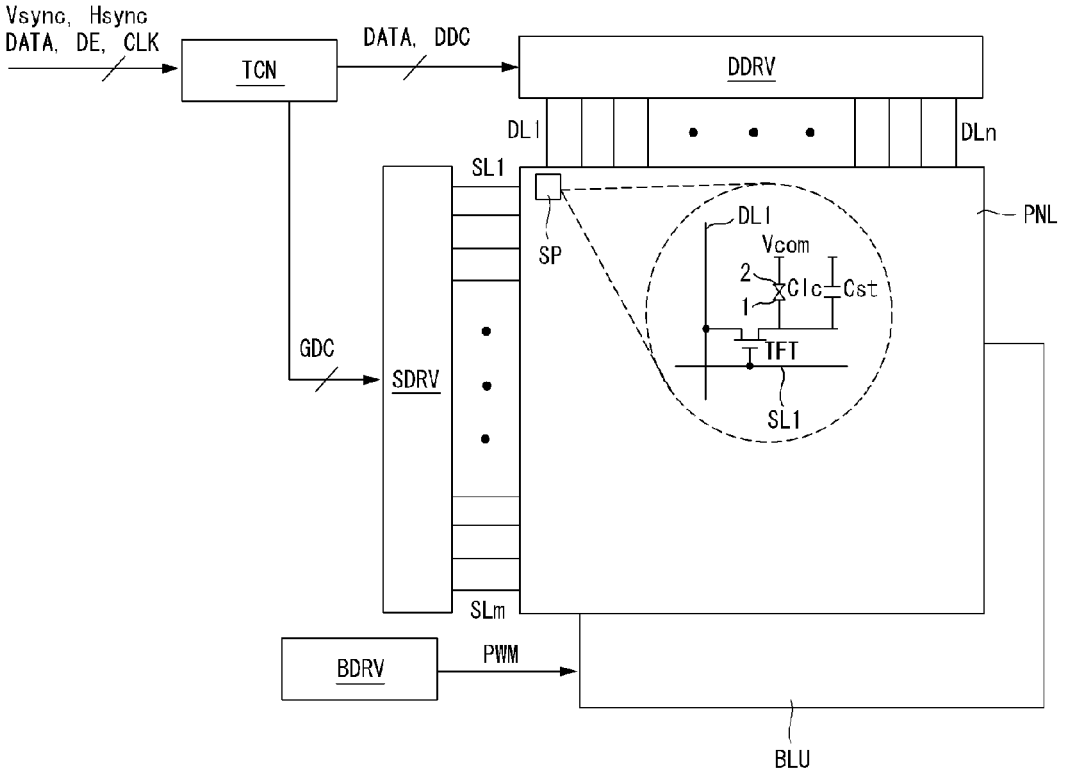
FIG. 1 is a block diagram of a liquid crystal display.
Figure 2:
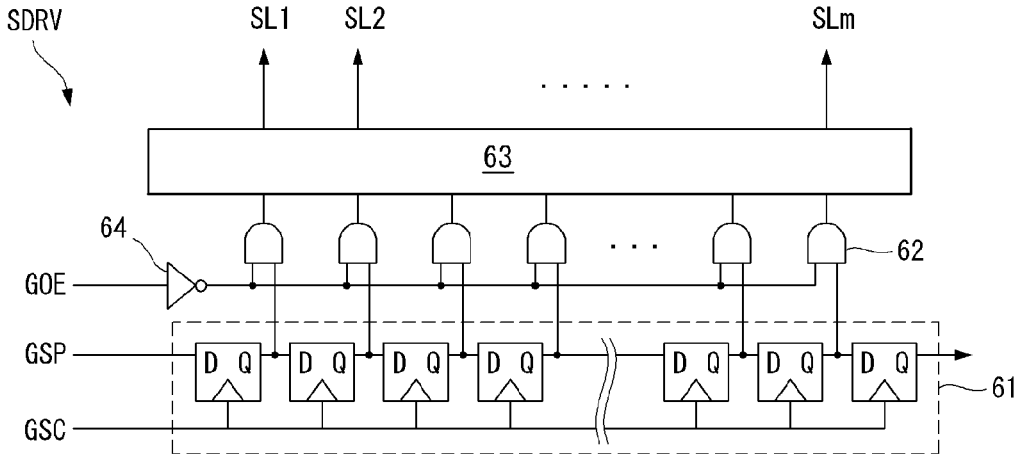
FIG. 2 is a block diagram of a gate driver.
Figure 3:
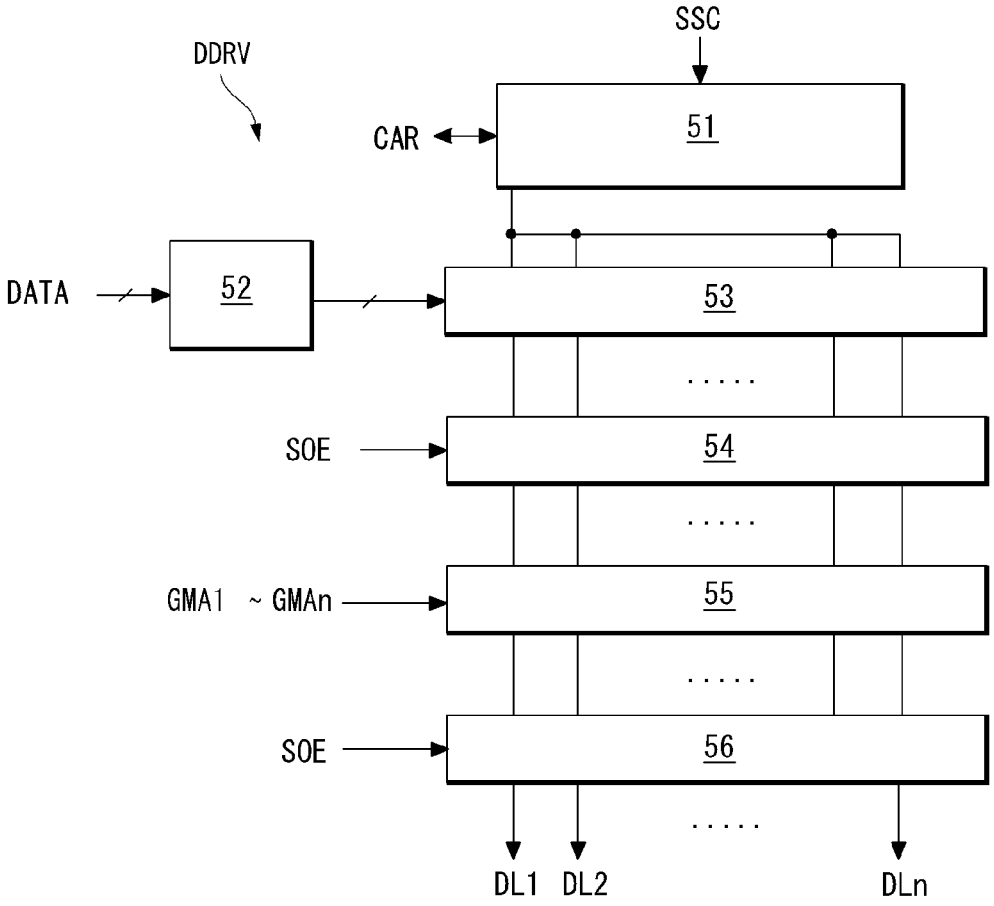
FIG. 3 is a block diagram of a data driver.

FIG. 1 is a block diagram of a liquid crystal display. FIG. 2 is a block diagram of a gate driver. FIG. 3 is a block diagram of a data driver.

As shown in FIG. 1, the liquid crystal display comprises a timing driver TCN, a liquid crystal panel PNL, a gate driver SDRV, a data driver DDRV, and a backlight unit BLU, and a backlight unit driver BDRV.

The timing driver TCN receives a vertical synchronous signal Vsync, a horizontal synchronous signal Hsync, a data enable signal DE, a clock signal CLK, and a data signal DATA from an external source. The timing driver TCN controls an operation timing of the data driver DDRV and an operation timing of the gate driver SDRV using timing signals such as the vertical synchronous signal Vsync, the horizontal synchronous signal Hsync, the data enable signal DE, and the clock signal CLK.

In this case, because the timing driver TCN can determine a frame period by counting the data enable signal DE for indicating one horizontal period, the vertical synchronous signal Vsync and the horizontal synchronous signal Hsync may be omitted. The timing driver TCN generates control signals GDC for controlling a panel driver driving the liquid crystal panel PNL, together with the gate driver SDRV and the data driver DDRV. The control signals GDC and DDC may include a gate timing control signal GDC for controlling the operation timing of the gate driver SDRV and a data timing control signal DDC for controlling the operation timing of the data driver DDRV.

The liquid crystal panel PNL comprises a thin film transistor (hereinafter, abbreviated as TFT) substrate, a color filter substrate, a liquid crystal layer between the TFT substrate and the color filter substrate, and a plurality of subpixels arranged in a matrix form. Data lines, gate lines, TFTs, storage capacitors, and the like are formed on the TFT substrate. A black matrix, a color filter, and the like are formed on the color filter substrate.

One subpixel SP is defined by the data line DL1 and the gate line SL1 crossing each other. Each of the plurality of subpixels SP comprises the TFT driven by the gate signal supplied through the gate line SL1, the storage capacitor Cst for storing the data signal RGB supplied through the data line DL1, and a liquid crystal cell C1*c*.

The liquid crystal cell C1*c* is driven by the data voltage supplied to a pixel electrode 1 and a common voltage Vcom supplied to a common electrode 2. In a vertical electric field drive manner such as a twisted nematic (TN) mode and a vertical alignment (VA) mode, the common electrode 2 is formed on the color filter substrate. In a horizontal electric field drive manner such as an in-plane switching (IPS) mode and a fringe field switching (FFS) mode, the common electrode 2 is formed on the TFT substrate along with the pixel electrode 1. Polarizing plates are respectively attached to the TFT substrate and the color filter substrate of the liquid crystal panel PNL. Alignment layers for setting a pre-tilt angle of liquid crystals are respectively formed on the TFT substrate and the color filter substrate. The liquid crystal panel PNL applicable to the embodiment of the invention may be implemented in any liquid crystal mode as well as the TN, VA, IPS, and FFS modes.

The gate driver SDRV sequentially generates a gate signal in response to the gate timing control signal GDC received from the timing driver TCN. The gate driver SDRV supplies the gate signal through gate lines SL1 to SLm to the subpixels SP of the liquid crystal panel PNL.

As shown in FIG. 2, the gate driver SDRV comprises a plurality of gate driver ICs. Each of the plurality of gate driver ICs comprises a shift register 61, a level shifter 63, a plurality of AND gates 62 connected between the shift register 61 and the level shifter 63, an inverter 64 for inverting the gate output enable signal GOE, and the like. The shift register 61 sequentially shifts the gate start pulse GSP in response to the gate shift clock GSC using a plurality of cascade-connected D-flip flops. Each of the AND gates 62 performs an AND operation on an output signal of the shift register 61 and an inversion signal of the gate output enable signal GOE to generate an output. The inverter 64 inverts the gate output enable signal GOE and supplies the inverted signal of the gate output enable signal GOE to the AND gates 62. The level shifter 63 shifts a swing width of an output voltage of the AND gates 62 to the swing width of the gate voltage capable of operating the transistors of the liquid crystal panel PNL. The gate signal output from the level shifter 63 is sequentially supplied to the gate lines SL1 to SLm. On the other hand, the gate driver SDRV may be formed on the panel in a Gate-In Panel scheme.

The data driver DDRV samples and latches the data signal RGB received from the timing driver TCN in response to the data timing control signal DDC received from the timing driver TCN and converts the latched data signal DATA into parallel data. When the data driver DDRV converts the data signal DATA into the parallel data, the data driver DDRV converts the data signal DATA based on a gamma reference voltage. The data driver DDRV supplies the converted data signal DATA to the subpixels SP of the liquid crystal panel PNL through data lines DL1 to DLn.

As shown in FIG. 3, the data driver DDRV comprises a shift register 51, a data register 52, a first latch 53, a second latch 54, a converter 55, an output circuit 56, and the like. The shift register 51 shifts the source sampling clock SSC received from the timing driver TCN. For example, the shift register 51 of one data driver IC transfers a carry signal CAR to the shift register 51 of a next data driver IC. The data register 52 temporarily stores the data signal DATA received from the timing driver TCN and supplies it to the first latch 53. The first latch 53 samples and latches the serially input data signal DATA in response to a clock sequentially received from the shift register 51. The first latch 53 then simultaneously outputs the latched data to the second latch 54. The second latch 54 latches the latched data received from the first latch 53 and then simultaneously outputs the latched data in synchronization with second latches 54 of other source drives ICs in response to the source output enable signal SOE. The converter 55 converts the data signal DATA received from the second latch 54 based on gamma reference voltages GMA1 to GMAn. The data output from the output circuit 56 is supplied to the data lines DL1 to DLn in response to the source output enable signal SOE.

The backlight unit BLU provides light to the liquid crystal panel PNL. The backlight unit BLU includes light emitting sources, a light source device portion comprising driving transistors driving the light emitting sources, and an optical apparatus portion comprising a cover bottom, a light guide plate, and an optical sheet. The backlight unit BLU may be configured as an edge type, a dual type, a direct type, etc. The edge type is a string of light emitting diodes arranged on one side of the liquid crystal panel PNL. The dual type is a string of light emitting diodes arranged on both sides of the liquid crystal panel PNL. The direct type is a block or matrix of light emitting diodes arranged under the liquid crystal panel PNL.

The backlight unit driver BDRV controls the driving transistors driving the backlight unit BLU, as well as the backlight unit BLU. The backlight unit DBRV drives the driving transistors included in the backlight unit BLU based on a pulse width modulation (PWM) signal. The backlight unit driver BDRV may dims the backlight unit globally or locally by using the pulse width signal.

Hereinafter, the backlight unit and the backlight unit driver according to exemplary embodiments of the present invention will be described in more detail.

First Exemplary Embodiment

Figure 4:
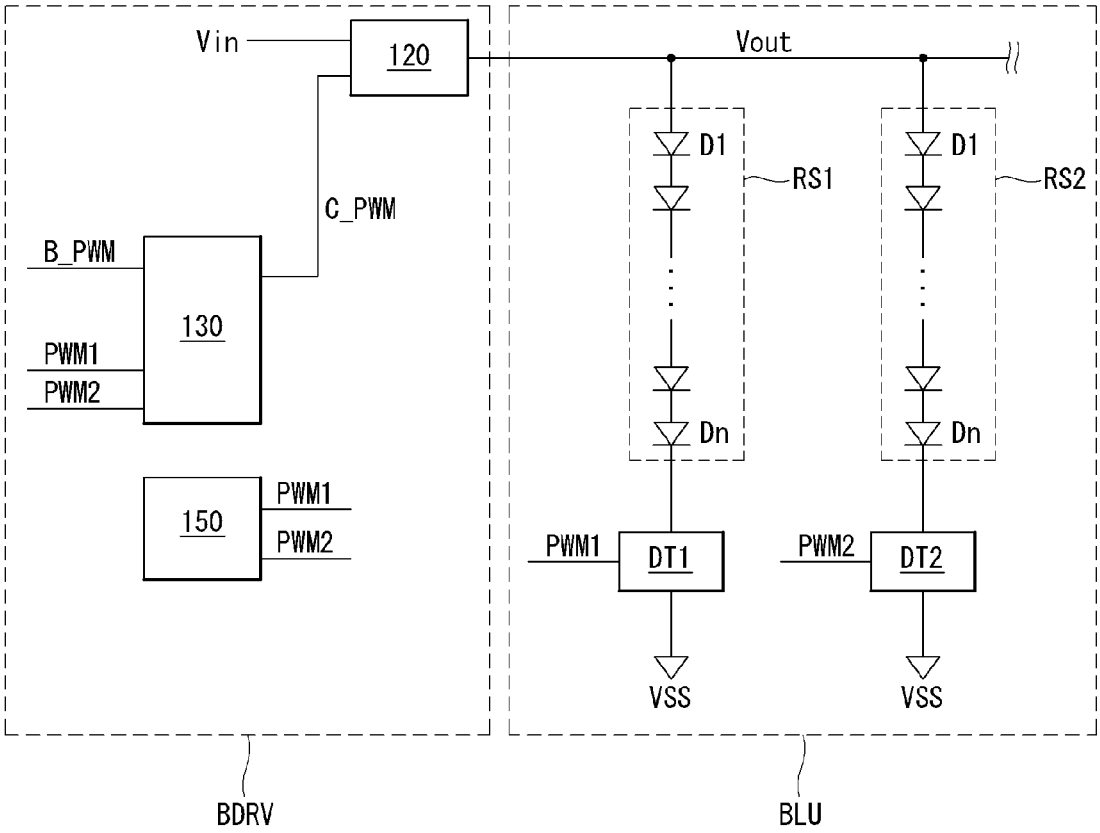
FIG. 4 is a schematic circuit configuration diagram of a backlight unit and a backlight unit driver according to a fist exemplary embodiment of the present invention.
Figure 5:
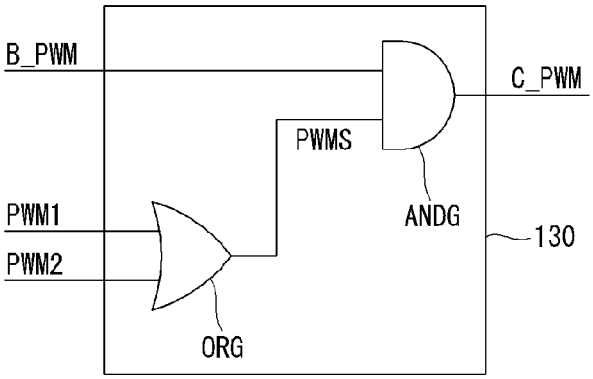
FIG. 5 is a detailed circuit configuration diagram of a power controller shown in FIG. 4.

FIG. 4 is a schematic circuit configuration diagram of a backlight unit and a backlight unit driver according to a fist exemplary embodiment of the present invention. FIG. 5 is a detailed circuit configuration diagram of a power controller shown in FIG. 4.

As shown in FIGS. 4 and 5, the backlight unit BLU comprises light emitting sources RS1 and RS2 and driving transistors DT1 and DT2. The backlight unit driver BDRV comprises a transistor driver 150, a DC power source 120, and a power controller 130.

Each of the light emitting sources RS1 and RS2 comprises light emitting diodes D1 to Dn connected in series. In the first light emitting source RS1, an anode of the first light emitting diode D1 is connected to an output terminal Vout of the DC power source 120, and a cathode of the n-th light emitting diode Dn is connected to a first electrode of the first driving transistor DT1. In the second light emitting source RS2, an anode of the first light emitting diode D1 is connected to the output terminal Vout of the DC power source 120, and a cathode of the n-th light emitting diode Dn is connected to a first electrode of the second driving transistor DT2. The light emitting sources RS1 and RS2 are driven by pulse width modulation signals PWM1 and PWM2 supplied to the gate electrodes of the driving transistors DT1 and DT2, thereby emitting light.

The driving transistors DT1 and DT2 are driven by the pulse width modulation signals PWM1 and PWM2 output from the transistor driver 150. The first driving transistor DT1 drives the first light emitting source RS1 based on the first pulse width modulation signal PWM1, and the second driving transistor DT2 drives the second light emitting source RS2 based on the second pulse width modulation signal PWM2. Each of the driving transistors DT1 and DT2 is an FET (Field Effect Transistors) whose gate electrode is controlled by a pulse width modulation signal to control the current flowing through the source electrode and the drain electrode.

The transistor driver 150 generates the first pulse width modulation signal PWM1 for driving the first driving transistor DT1 and the second pulse width modulation signal PWM2 for driving the second driving transistor DT2, and supplies them to the first driving transistor DT1 and the second driving transistor DT2, respectively. Although the drawings show an example in which the transistor driver 150 controls only two driving transistors DT1 and DT2, the transistor driver 150 also can control an N (N is an integer more than 2) driving transistors.

The DC power source 120 boosts a first DC power voltage supplied to an input terminal Vin into a second DC power voltage and outputs it to an output terminal Vout in order to supply stable power to the light emitting sources RS1 and RS2. The DC power source 120 may be a DC-to-DC converter (DCDC) which boosts the first DC power voltage into the second DC power voltage. The DC power source 120 comprises a switching transistor whose output is boosted by signal C_PWM supplied from the power controller 130. The switching transistor is an FET or the like. Moreover, the DC power source 120 further comprises a plurality of devices (such as an inductor, a resistor, a capacitor, and a diode).

The power controller 130 drives the DC power source 120, and enables or disables an output of the DC power source 120. The power controller 130 performs an AND operation on the first signal B_PWM supplied externally and the second signals PWM1 and PWM2 controlling the driving transistors DT1 and DT2 to generate a result value, and enables or disables the output of the DC power source 120 based on the result value.

In the exemplary embodiment, as an example, the boost pulse width modulation signal B_PWM generated outside the power controller 130 is supplied as the first signal B_PWM in order to boost the DC power source 120. The first signal B_PWM may be any pulse continuously alternating between the logic high state and the logic low. Also, the first signal B_PWM may be any pulse continuously representing the logic high state even if it is not a pulse width modulation signal.

The power controller 130 enables or disables the DC power source 120 based on the driving state of the driving transistors DT1 and DT2. Accordingly, the second pulse width modulation signals PWM1 and PWM2 for controlling the driving transistors DT1 and DT2 are selected as the second signals PWM1 and PWM2.

As shown in FIG. 5, the power controller 130 comprises an OR gate ORG for performing an OR operation on the second signals PWM and PWM2 and an AND gate ANDG for performing an AND operation on an output value of the OR gate ORG and the first signal B_PWM.

The power controller 130 performs an OR operation on the second signals PWM1 and PWM2 by the OR gate ORG to generate a third signal PWMS. Next, the power controller 130 performs an AND operation on the third signal PWMS and the first signal B_PWM by the AND gate ANDG to generate a fourth signal C_PWM. The power controller 130 performs an OR operation on the second signals PWM1 and PWM2 by the OR gate ORG and an AND operation on the third signal PWMS and the first signal B_PWM by the AND gate ANDG to generate the fourth signal C_PWM as a result value, and enables or disables an output of the DC power source 120 based on the fourth signal C_PWM. At this point, the power controller 130 may enable or disable the switching operation of the DC power source 120 by supplying the fourth signal C_PWM directly to the gate electrode of the switching transistor of the DC power source 120.

Hereinafter, the operation of the backlight unit driver will be described in more detail.

Figure 6:
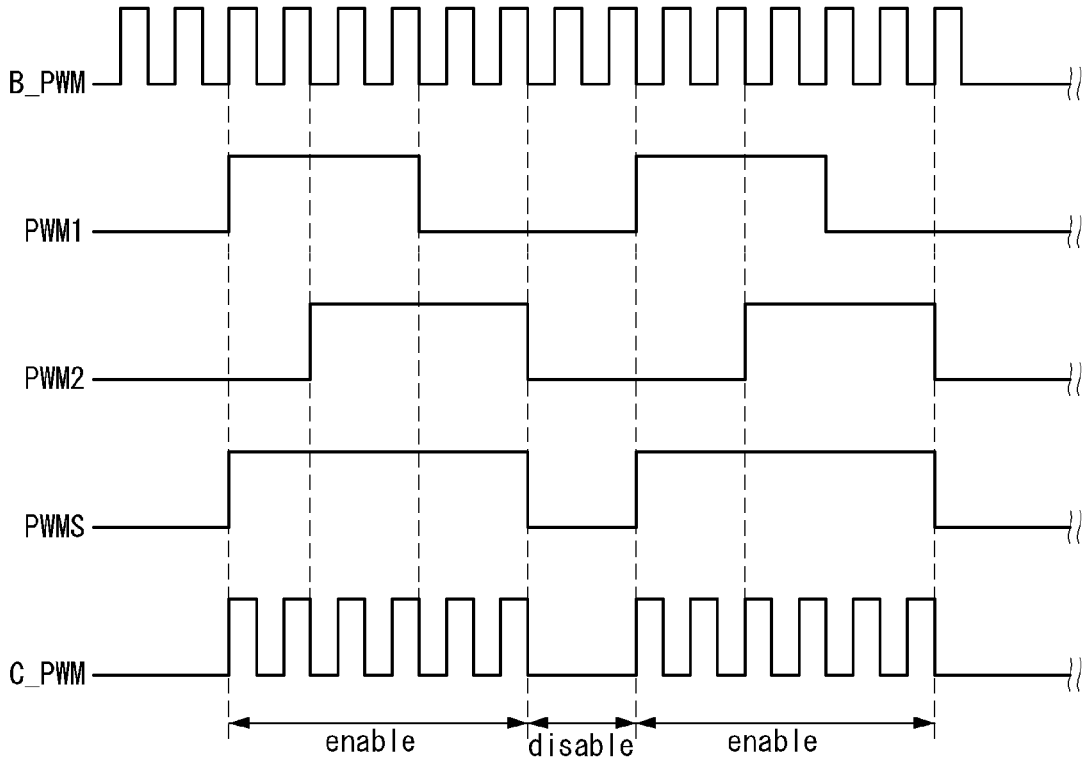
FIGS. 6 and 7 are waveform diagrams for explaining the operation of the backlight unit driver.
Figure 7:
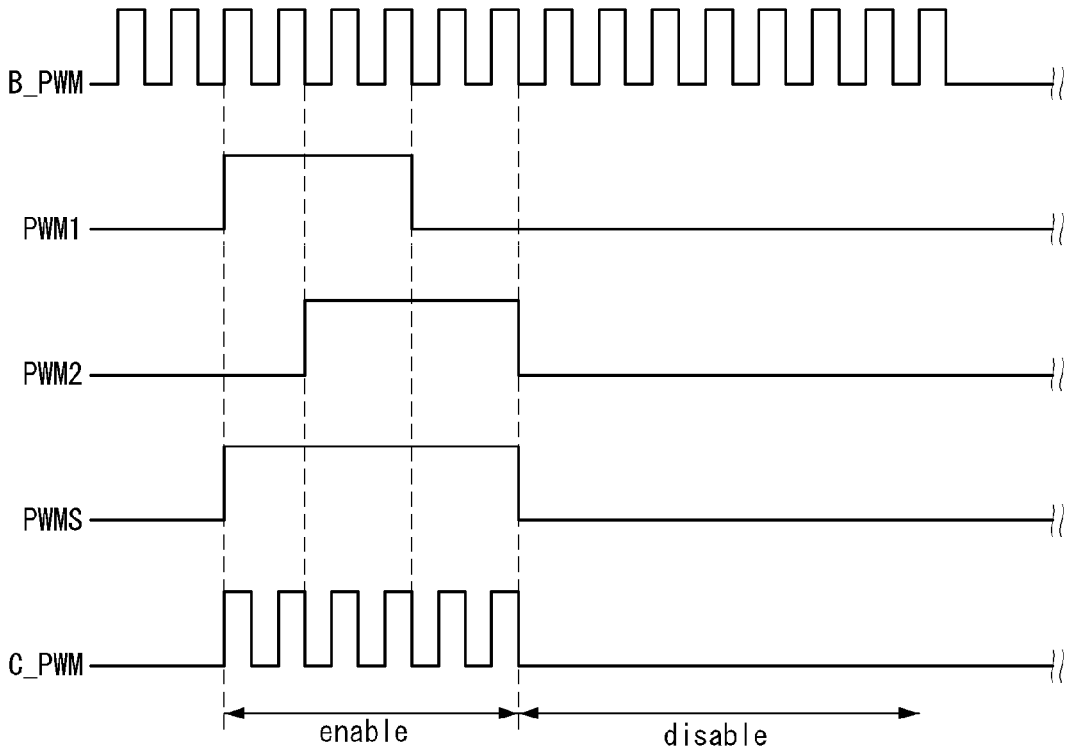
Figure 8:
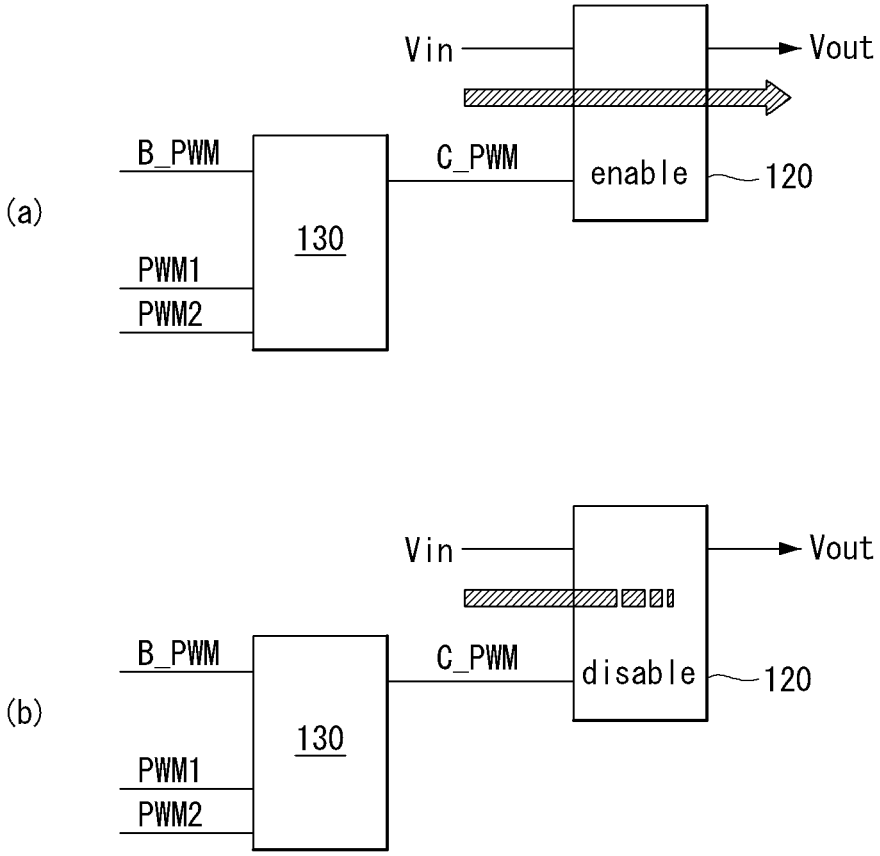
FIG. 8 is a view for explaining the operating state of the backlight unit driver depending on the waveforms of FIGS. 6 and 7.

FIGS. 6 and 7 are waveform diagrams for explaining the operation of the backlight unit driver. FIG. 8 is a view for explaining the operating state of the backlight unit driver depending on the waveforms of FIGS. 6 and 7.

An example in which the power controller 130 of the backlight unit driver BDRV enables or disables the DC power source 120 as shown in FIGS. 4 to 8 will be described below.

The power controller 130 is supplied with the first signal B_PWM and is supplied with the second signals PWM1 and PWM2 corresponding to the first and second pulse width modulation signals PWM1 and PWM2 for controlling the driving transistors DT1 and DT2. That is, the power controller 130 receives, as the second signals PWM1 and PWM2, the first and second pulse width modulation signals PWM1 and PWM2 output from the transistor driver 150.

The OR gate ORG of the power controller 130 performs an OR operation on the second signals PWM1 and PWM2 to generate the third signal PWMS. Next, the AND gate ANDG of the power controller 130 performs an AND operation on the third signal PWMS and the first signal B_PWM to generate the fourth signal C_PWM as a result value.

The power controller 130 supplies the fourth signal C_PWM to the DC power source 120. Then, the DC power source 120 enables or disables the DC power source 120 in response to the fourth signal C_PWM supplied from the power controller 130. An enable interval of the DC power source 120 is an interval in which at least one of the second signals PWM1 and PWM2 is kept at logic high. On the other hand, a disable interval of the DC power source 120 is an interval in which the second signals PWM1 and PWM2 are all kept at logic low.

In the above description, FIG. 6 depicts an example in which the second signals PWM1 and PWM2 with a phase difference are supplied due to dimming or the like. The second signals PWM1 and PWM2 have the predetermined phase difference for the sake of reducing the noise. On the other hand, FIG. 7 depicts an example in which the transistor driver 150 is temporarily stopped from being operated due to external or internal cause.

As can be seen from the above description, the power controller 130 supplies a signal for enabling an output of the DC power source 120 or a signal for disabling the same depending on the state of the first and second pulse width modulation signals PWM1 and PWM2 for controlling the driving transistors DT1 and DT2. In other words, the power controller 130 supplies a signal for enabling an output of the DC power source 120 or a signal for disabling the same whether the light emitting sources RS1 and RS2 acting as a load are driven or not.

Second Exemplary Embodiment

Figure 9:
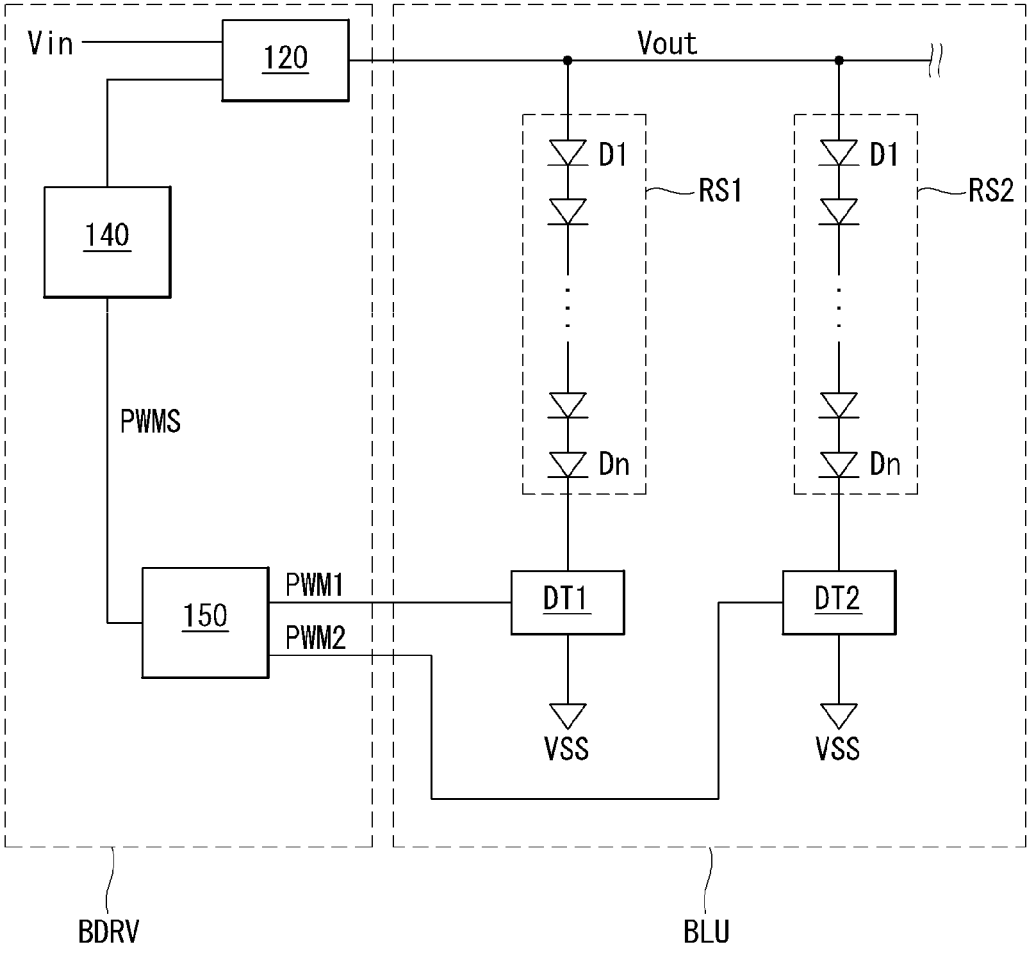
FIG. 9 is a schematic circuit configuration diagram of a backlight unit and a backlight unit driver according to a second exemplary embodiment of the present invention.
Figure 10:
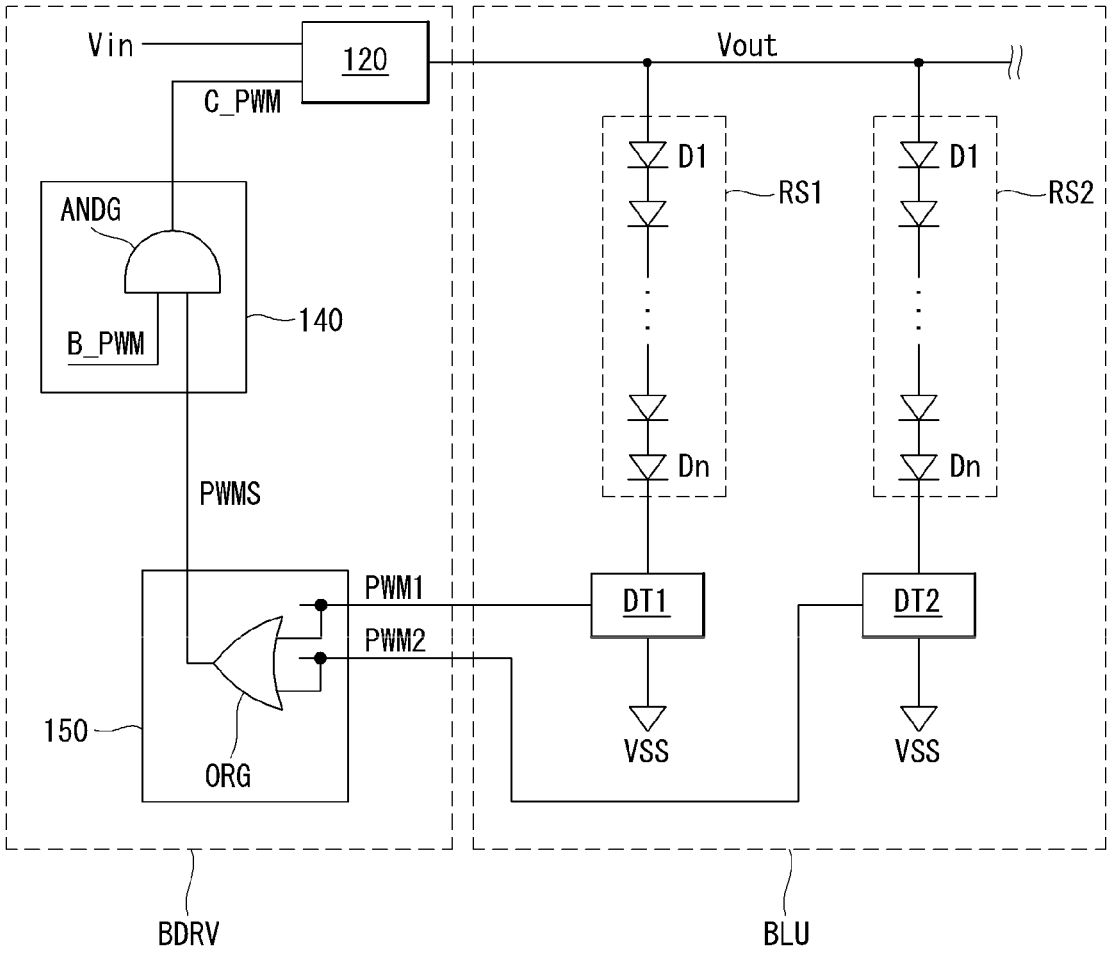
FIG. 10 is a detailed circuit configuration diagram of a transistor driver and a pulse width modulator shown in FIG. 9.

FIG. 9 is a schematic circuit configuration diagram of a backlight unit and a backlight unit driver according to a second exemplary embodiment of the present invention. FIG. 10 is a detailed circuit configuration diagram of a transistor driver and a pulse width modulator shown in FIG. 9.

As shown in FIGS. 9 and 10, the backlight unit BLU comprises light emitting sources RS1 and RS2 and driving transistors DT1 and DT2. The backlight unit driver BDRV comprises a transistor driver 150, a DC power source 120, and a pulse width modulator 140.

The light emitting sources RS1 and RS2 comprise light emitting diodes D1 to Dn connected in series. In the first light emitting source RS1, an anode of the first light emitting diode D1 is connected to an output terminal Vout of the DC power source 120, and a cathode of the n-th light emitting diode Dn is connected to a first electrode of the first driving transistor DT1. In the second light emitting source RS2, an anode of the first light emitting diode D1 is connected to the output terminal Vout of the DC power source 120, and a cathode of the n-th light emitting diode Dn is connected to a first electrode of the second driving transistor DT2. The light emitting sources RS1 and RS2 are driven by pulse width modulation signals PWM1 and PWM2 supplied to the gate electrodes of the driving transistors DT1 and DT2, thereby emitting light.

The driving transistors DT1 and DT2 are driven by the pulse width modulation signals PWM1 and PWM2 output from the transistor driver 150. The first driving transistor DT1 drives the first light emitting source RS1 based on the first pulse width modulation signal PWM1, and the second driving transistor DT2 drives the second light emitting source RS2 based on the second pulse width modulation signal PWM2. Each of the driving transistors DT1 and DT2 is an FET (Field Effect Transistors) whose gate electrode is controlled by a pulse width modulation signal to control the current flowing through the source electrode and the drain electrode.

The DC power source 120 boosts a first DC power voltage supplied to an input terminal Vin into a second DC power voltage and outputs it to an output terminal Vout in order to supply stale power to the light emitting sources RS1 and RS2. The DC power source 120 may be a DC-to-DC converter (DCDC) which boosts the first DC power into the second DC power. An output of the DC power source 120 is boosted by a boost pulse width modulation signal B_PWM supplied from the pulse width modulator 140. The DC power source 120 comprises a switching transistor whose output is boosted by signal C_PWM supplied from the pulse width modulator 140. The switching transistor is an FET or the like. Moreover, the DC power source 120 further comprises a plurality of devices (such as an inductor, a resistor, a capacitor, and a diode).

The transistor driver 150 generates the first pulse width modulation signal PWM1 for driving the first driving transistor DT1 and the second pulse width modulation signal PWM2 for driving the second driving transistor DT2, and supplies them to the first driving transistor DT1 and the second driving transistor DT2, respectively. Moreover, the transistor driver 150 supplies the pulse width modulator 140 with a signal PWMS, which is generated by performing an operation with respect to the first pulse width modulation signal PWM1 and the second pulse width modulation signal PWM2. The transistor driver 150 supplies the pulse width modulator 140 with the signal PWMS generated by an operation as a reference signal for enabling or disabling the output of the DC power source 120. Although the drawings show an example in which the transistor driver 150 controls only two driving transistors DT1 and DT2, the transistor driver 150 also can control an N (N is an integer more than 2) driving transistors.

The pulse width modulator 140 drives the DC power source 120, and enables or disables an output of the DC power source 120. The pulse width modulator 140 boosts and drives the DC power source 120 by using a boost pulse width modulation signal B_PWM generated internally. The pulse width modulator 140 can adjust the power output through the output terminal Vout of the DC power source 120 by monitoring the output terminal Vout of the DC power source 120. The pulse width modulator 140 performs an AND operation on the signal generated internally and the signal supplied from the transistor driver 150 to generate a result value, and enables or disables the output of the DC power source 120 based on the result value. The pulse width modulator 140 may be a pulse width modulation circuit which internally and directly generates the boost pulse width modulation signal B_PWM.

As shown in FIG. 10, the transistor driver 150 comprises an OR gate ORG for performing an OR operation on the second signals PWM and PWM2. Moreover, the pulse width modulator 140 comprises an AND gate ANDG for performing an AND operation on an output value of the OR gate ORG and the first signal B_PWM.

As used herein, the boost pulse width modulation signal B_PWM generated inside the pulse width modulator 140 is selected as the first signal B_PWM in order to boost the DC power source 120. However, the first signal B_PWM may be any pulse continuously representing the logic high state or continuously alternating between the logic high state and the logic low state even if it is not a pulse width modulation signal.

The pulse width modulator 140 enables or disables the DC power source 120 based on the driving state of the driving transistors DT1 and DT2. Accordingly, the second pulse width modulation signals PWM1 and PWM2 output from the transistor driver 150 are selected as the second signals PWM1 and PWM2. The transistor driver 150 performs an OR operation on the second signals PWM1 and PWM2 by the OR gate ORG to generate a third signal PWMS, and supplies the third signal PWMS to the pulse width modulator 140. The pulse width modulator 140 performs an AND operation on the third signal PWMS supplied from the OR gate ORG of the transistor driver 150 and the first signal B_PWM by the AND gate ANDG to generate a fourth signal C_PWM as a result value. That is, the transistor driver 150 and the pulse width modulator 140 generate the fourth signal C_PWM by the OR gate ORG and the AND gate ANDG respectively included therein, and enables or disables the output of the DC power source 120 based on the fourth signal C_PWM.

As explained with reference to FIGS. 6 to 8 of the first exemplary embodiment, the above-described transistor driver 150 and pulse width modulator 140 as well supply a signal for enabling an output of the DC power source 120 or a signal for disabling the same depending on the state of the first and second pulse width modulation signals PWM1 and PWM2 for controlling the driving transistors DT1 and DT2, in other words, whether the light emitting sources RS1 and RS2 acting as a load are driven or not.

Third Exemplary Embodiment

Hereinafter, a driving method of a liquid crystal display according to a third exemplary embodiment of the present invention will be described.

Figure 11:
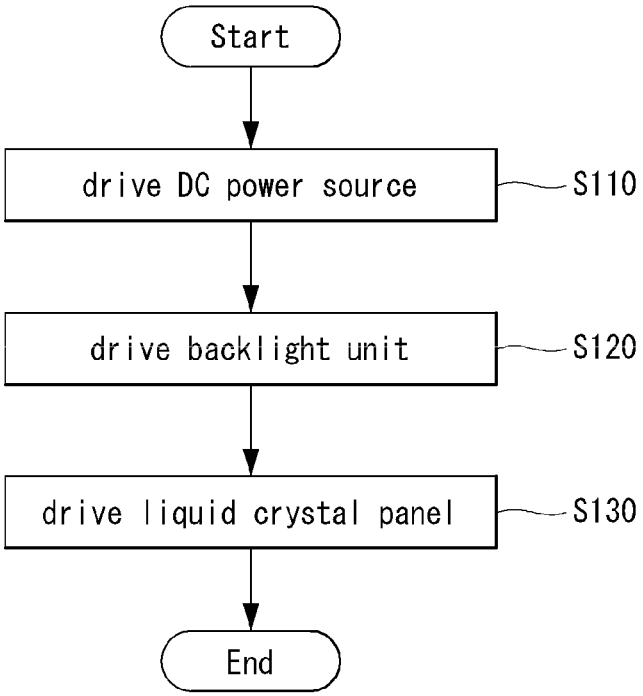
FIG. 11 is a flowchart showing a schematic driving method of a liquid crystal display according to a third exemplary embodiment of the present invention.
Figure 12:
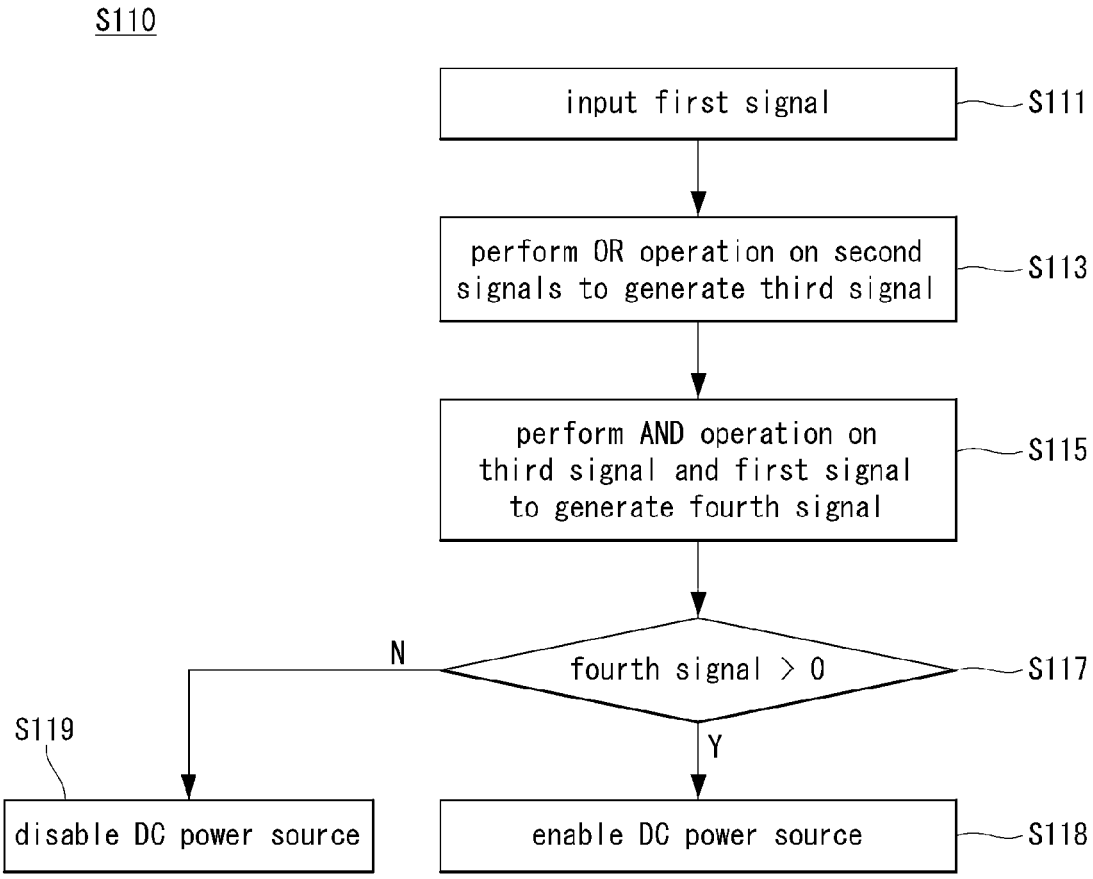
FIG. 12 is a detailed flow chart of a DC power source driving step of FIG. 11.

FIG. 11 is a flowchart showing a schematic driving method of a liquid crystal display according to a third exemplary embodiment of the present invention. FIG. 12 is a detailed flow chart of a DC power source driving step of FIG. 11.

The driving method of a liquid crystal display according to the third exemplary embodiment of the present invention will be described with reference to FIGS. 4, 5, 9, and 10 along with FIGS. 11 and 12.

As shown in FIG. 11, the schematic driving method of a liquid crystal display according to the third exemplary embodiment of the present invention comprises a DC power source driving step S110, a backlight unit driving step S120, and a liquid crystal panel driving step S130.

The DC power source driving step S110 is a step of driving the DC power source 120 to boost a first DC power voltage supplied from an external source into a second DC power voltage and supply it to the backlight unit BLU. In this step, DC power is supplied to the anodes of the light emitting sources RS1 and RS2 of the backlight unit BLU.

The backlight unit driving step S120 is a step of driving the driving transistors DT1 and DT2 for driving the backlight unit BLU to emit light from the backlight unit BLU. In this step, the driving transistors DT1 and DT2 of the backlight driver BRDV are driven by the pulse width modulation signals PWM1 and PWM2 output from the transistor driver 150. Also, the DC power supplied to the anodes of the light emitting sources RS1 and RS2 flows through the source electrodes and drain electrodes of the driving transistors DT1 and DT2. Then, the light emitting sources RS1 and RS2 emit light.

The liquid crystal panel driving step S130 is a step of displaying an image on the liquid crystal panel using the light emitted from the backlight unit BLU. In this step, the liquid crystal panel receives gate signals and data signals, and therefore the liquid crystal layer included in the corresponding sub-pixels is driven. Also, the liquid crystal panel displays an image by the emitted light depending on the driving state of the liquid crystal layer.

Meanwhile, in the DC power source driving step S110 of the process in which the liquid crystal display is driven to display an image as described above, the output of the DC power source 120 is enabled or disabled with reference to the signals supplied to the driving transistors DT1 and DT2.

More specifically, in the DC power source driving step S110, an AND operation on the first signal supplied externally or generated internally and the second signals for controlling the driving transistors DT1 and DT2 to generate a result value, and the output of the DC power source 120 is enabled or disabled based on the result value.

To this end, in the DC power source driving step S110, a driving operation as shown in FIG. 12 is conducted.

First, the first signal B_PWM supplied externally or generated internally is input (S111). As the first signal B_PWM, a signal corresponding to the boost pulse width modulation signal B_PWM may be selected, or a pulse continuously representing the logic high state or a pulse continuously alternating between the logic high state and the logic low state may be selected.

Next, an OR operation is performed on the second signals PWM1 and PWM2 to generate the third signal PWMS (S113). The second signals PWM1 and PWM2 are selected as signals corresponding to the first and second pulse width modulation signals PWM1 and PWM2.

Next, an AND operation is performed on the third signal PWMS and the first signal B_PWM to generate the fourth signal C_PWM as a result value (S115). The fourth signal C_PWM serves as a signal which substantially controls an output of the DC power source 120.

Next, the output of the DC power source 120 is enabled (S118) or disabled (S119) based on the fourth signal. In this step, whether to enable (S118) or disable (S199) the output of the DC power source 120 is determined depending on a logic value of the fourth signal C_PWM. That is, if the logic value of the fourth signal C_PWM is greater than 0 (Y), the output of the DC power source 120 is enabled (S118). On the other hand, if the logic value of the fourth signal C_PWM is less than 0 (N), the output of the DC power source 120 is disabled (S119). As used herein, "0" should be construed as meaning that the fourth signal is continuously kept at the logic low state during a certain period of time.

As shown in FIGS. 6 and 7, the first signal B_PWM is supplied at a frequency fast compared to other signals, and its logic value is close to the logic high state. Therefore, it can be concluded that, if the first signal B_PWM is thoughted to the logic high state, the logic value of the fourth signal C_PWM is as a result dependent on the second signals PWM1 and PWM2.

The second signals PWM1 and PWM2 are signals that control the driving transistors DT1 and DT2 for driving the light emitting sources RS1 and RS2. Therefore, whether to enable (S118) or disable (S119) the output of the DC power source 120 is determined depending on whether the light emitting sources RS1 and RS2 acting as a load are driven or not. Moreover, the output of the DC power source 120 is disabled (S119) during an interval in which the second signals PWM1 and PWM2 are all in the logic low state.

As seen above, the exemplary embodiments of the present invention provide a liquid crystal display, which enables or disables the DC power source depending on the load of the backlight unit, and a driving method thereof. Moreover, the exemplary embodiments of the present invention provide a liquid crystal display, which is able to stop the boosting operation of the DC power source by forcibly disabling the boosting of the DC power source if the backlight unit is in a load-off condition. Furthermore, the exemplary embodiments of the present invention provide a liquid crystal display, which minimizes voltage ripple at an output terminal of the DC power source while in the load-off condition, and therefore solves the problem of noise.

The foregoing embodiments and advantages are merely exemplary and are not to be construed as limiting this document. The present teaching can be readily applied to other types of apparatuses. The description of the foregoing embodiments is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A liquid crystal display, comprising:

a liquid crystal panel;

a panel driver configured to drive the liquid crystal panel;

light emitting sources configured to provide light to the liquid crystal panel;

driving transistors configured to drive the light emitting sources;

a transistor driver configured to control the driving transistors;

a DC power source configured to supply DC power to the light emitting sources; and a power controller configured to:

perform a logic operation, on a first signal supplied externally and on a plurality of second signals generated by the transistor driver, to generate a result value, the logic operation comprising:

an OR operation performed on the second signals to generate a third signal; and an AND operation performed on the third signal and the first signal to generate a fourth signal as the result value; and enable or disable an output of the DC power source based on the result value, wherein each of the first signal and the plurality of second signals comprises a pulse width modulation signal, and wherein at least two of the plurality of second signals have overlapping high periods.

2. The liquid crystal display of claim 1, wherein the power controller comprises:

an OR gate for performing the OR operation on the second signals; and an AND gate for performing the AND operation on an output of the OR gate and the first signal.

3. The liquid crystal display of claim 1, wherein the power controller is further configured to disable the output of the DC power source during an interval in which the second signals are all in the logic low state.

4. A liquid crystal display, comprising:

a liquid crystal panel;

a panel driver configured to drive the liquid crystal panel;

light emitting sources configured to provide light to the liquid crystal panel;

driving transistors configured to drive the light emitting sources;

a transistor driver configured to control the driving transistors;

a DC power source configured to supply DC power to the light emitting sources; and a pulse width modulator, configured to:

perform a logic operation on a signal generated internally and a signal supplied from the transistor driver to generate a result value;

enable or disable an output of the DC power source based on the result value; and generate a first signal for controlling the DC power source, wherein the transistor driver is further configured to:

generate a plurality of second signals for controlling the driving transistors, and perform an OR operation on the plurality of second signals to generate a third signal and supply the same to the pulse width modulator, wherein the pulse width modulator is further configured to perform an AND operation, on the third signal and the first signal, to generate a fourth signal as the result value, wherein each of the first signal and the plurality of second signals comprises a pulse width modulation signal, and wherein at least two of the plurality of second signals have overlapping high periods.

5. The liquid crystal display of claim 4, wherein:

the transistor driver comprises an OR gate configured to perform the OR operation on the second signals; and the pulse width modulator comprises an AND gate configured to perform the AND operation on an output of the OR gate and the first signal.

6. The liquid crystal display of claim 4, wherein the pulse width modulator is further configured to disable the output of the DC power source during an interval in which the second signals are all in the logic low state.

7. A driving method of a liquid crystal display, the method comprising:

driving a DC power source to boost a first DC power voltage supplied from an external source into a second DC power voltage and supply the same to a backlight unit;

driving driving transistors of the backlight unit to emit light from the backlight unit; and displaying an image on the liquid crystal panel using the light emitted from the backlight unit, wherein, in the driving of the DC power source, an output of the DC power source is enabled or disabled with reference to signals supplied to the driving transistors, wherein, in the driving of the DC power source:

a logic operation is performed to generate a result value, the logic operation being performed on:

a first signal supplied externally or generated internally, and a plurality of second signals, an OR operation is performed on the second signals to generate a third signal, an AND operation is performed on the third signal and the first signal to generate a fourth signal as the result value, and an output of the DC power source is enabled or disabled based on the result value, wherein each of the first signal and the plurality of second signals comprises a pulse width modulation signal, and wherein at least two of the plurality of second signals have overlapping high periods.

8. The method of claim 7, wherein, in the driving of the DC power source, the output of the DC power source is disabled during an interval in which the second signals are all in the logic low state.

* * * * *